US009506354B2

(12) United States Patent
Mori et al.

(10) Patent No.: US 9,506,354 B2
(45) Date of Patent: Nov. 29, 2016

(54) TURBINE ROTOR AND STEAM TURBINE

(71) Applicant: KABUSHIKI KAISHA TOSHIBA, Minato-ku (JP)

(72) Inventors: Norimichi Mori, Kawasaki (JP); Itaru Murakami, Bunkyo-ku (JP); Tsutomu Yoshihara, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 467 days.

(21) Appl. No.: 14/087,837

(22) Filed: Nov. 22, 2013

(65) Prior Publication Data

US 2014/0079551 A1 Mar. 20, 2014

Related U.S. Application Data

(63) Continuation of application No. PCT/JP2012/003365, filed on May 23, 2012.

(30) Foreign Application Priority Data

May 23, 2011 (JP) ..... 2011-114893

(51) Int. Cl.
*F01D 5/22* (2006.01)
*F01D 5/30* (2006.01)
*F01D 5/32* (2006.01)

(52) U.S. Cl.
CPC ..... *F01D 5/225* (2013.01); *F01D 5/3046* (2013.01); *F01D 5/323* (2013.01); *F05D 2230/642* (2013.01)

(58) Field of Classification Search
CPC ..... F01D 5/22; F01D 5/225; F01D 5/3053; F01D 5/3023; F01D 5/303; F01D 5/3038; F01D 5/3046; F01D 5/32; F01D 5/323; F01D 5/326
USPC ..... 416/189, 190, 191, 212 A
See application file for complete search history.

(56) References Cited

U.S. PATENT DOCUMENTS 2,971,743 A 2/1961 Welsh
4,820,124 A * 4/1989 Fried ..... F01D 5/225 416/191

(Continued)

FOREIGN PATENT DOCUMENTS

CN 101336335 A 12/2008
EP 1764479 A1 3/2007

(Continued)

OTHER PUBLICATIONS

International Search Report mailed Aug. 14, 2012 in PCT/JP2012/003365, filed May 23, 2012 (with English Translation).

(Continued)

*Primary Examiner* — Richard Edgar
(74) *Attorney, Agent, or Firm* — Oblon, McClelland, Maier & Neustadt, L.L.P.

(57) ABSTRACT

A turbine rotor blade of the embodiment is made up of plural rotor blades each including: a blade effective part, a blade planting part, and a cover part, in which the cover parts adjacent in a turbine rotor circumferential direction are engaged with each other to make up an annular blade cascade. From among the rotor blades, a cover part of a stopping blade implanted to a planting part of the turbine rotor or the cover part of at least one of the rotor blades engaged with the cover part of the stopping blade is formed at the blade top part of the rotor blade so as to be able to be fitted when the rotor blade is installed in the turbine rotor.

10 Claims, 9 Drawing Sheets

(56) References Cited

U.S. PATENT DOCUMENTS

| | | | | |
|---|---|---|---|---|
| 2002/0081204 | A1* | 6/2002 | Burnett | F01D 5/225 416/190 |
| 2007/0212215 | A1 | 9/2007 | Ferber et al. | |
| 2009/0246029 | A1 | 10/2009 | Saito et al. | |
| 2009/0290983 | A1 | 11/2009 | Tanaka | |
| 2011/0008173 | A1 | 1/2011 | Tsukuda et al. | |
| 2014/0127020 | A1* | 5/2014 | Kim | F01D 5/303 416/179 |
| 2014/0255194 | A1* | 9/2014 | Jones | F01D 5/225 416/212 A |

FOREIGN PATENT DOCUMENTS

| | | | |
|---|---|---|---|
| EP | 1959098 | A1 | 8/2008 |
| GB | 1050027 | A | 12/1966 |
| GB | 1 509 185 | | 5/1978 |
| JP | 61-114007 | | 7/1986 |
| JP | 04-311603 | A | 11/1992 |
| JP | 05106404 | A * | 4/1993 |
| JP | 2007-154695 | A | 6/2007 |
| JP | 2009-281365 | A | 12/2009 |
| JP | 2011-017310 | A | 1/2011 |
| WO | 2007/063848 | A1 | 6/2007 |

OTHER PUBLICATIONS

Written Opinion of the International Searching Authority mailed Aug. 14, 2012 in PCT/JP2012/003365, filed May 23, 2012.

Combined Chinese Office Action and Search Report issued Mar. 28, 2014, in Chinese Patent Application No. 201210162662.X with English translation of category of cited documents.

International Preliminary Report on Patentability issued Dec. 5, 2013 in PCT/JP2012/003365 filed May 23, 2012.

Written Opinion issued Aug. 14, 2012 in PCT/JP2012/003365 filed May 23, 2012 submitting English translation only.

* cited by examiner

TURBINE ROTOR AND STEAM TURBINE

CROSS-REFERENCE TO RELATED APPLICATIONS

This application is a continuation of prior International Application No. PCT/JP2012/003365 filed on May 23, 2012, which is based upon and claims the benefit of priority from Japanese Patent Application No. 2011-114893 filed on May 23, 2011; the entire contents of all of which are incorporated herein by reference.

FIELD

Embodiments described herein relate generally to a turbine rotor blade including, for example, a cover integrally formed with a blade at a blade top part, and a steam turbine.

BACKGROUND

In general, a structure in which plural rotor blades are coupled by covers (snubber cover) integrally provided at blade top parts is used in a turbine rotor blade to suppress vibration generated during operation or to prevent steam from leaking out of the blade top part. This structure is known as a blade fastening structure enabling so-called a whole periphery integral blade.

A lot of arts studying about applicability of a shape of the cover, a degree of coupling between the rotor blades and the covers, a position of coupling, and so on are proposed as for the whole periphery integral blade structure. As an example, a turbine rotor blade including rotor blades in which a torsion preventing piece is provided at a blade planting part included at a bottom part side of a blade effective part, and a torsion return restricting piece where the torsion preventing piece is to be fitted is provided at a turbine wheel planting part is proposed.

SUMMARY

However, in the above-stated example of the turbine rotor blade, there is a case that a stopping blade of the turbine rotor blade which is implanted to the turbine wheel planting part lastly comes into contact and interfere with the snubber cover of an adjacent rotor blade when the rotor blades are installed in the turbine rotor planting part from a radial direction of the turbine rotor. In such a case, it is necessary to cut out the snubber cover of the adjacent rotor blade.

However, in the turbine rotor blade, it is necessary to bring the snubber covers of all blades into contact at the time of an assembling according to a structure thereof, and therefore, it is impossible to take a method avoiding the interference by cutting out the snubber cover of the rotor blade adjacent to the stopping blade (hereinafter, referred to as an "adjacent blade"). Accordingly, the interference is avoided by inserting the stopping blade (blade planting part) from diagonally upward of the blade effective part so as to avoid the snubber cover of the adjacent blade.

This method is effective when an effective length of the blade effective part of the adjacent blade is longer than a length of the stopping blade (blade planting part) in a turbine rotor axial direction. However, when the effective length of the blade effective part of the adjacent blade is shorter than the length of the stopping blade (blade planting part) in the turbine rotor axial direction, it is not effective because it is impossible to insert the stopping blade (blade planting part).

The present invention has been made to solve the above-stated problem, and an object thereof is to provide a turbine rotor blade and a steam turbine capable of inserting the stopping blade without interfering with the adjacent blade and making assembling of the turbine rotor blade easy.

To solve the above-stated problem, a turbine rotor blade of an embodiment is characterized in that: the turbine rotor blade is made up of plural rotor blades each including: a blade effective part; a blade planting part formed at a blade root part of the blade effective part to install in a turbine rotor from a turbine rotor radial direction; and a cover part formed at a blade top part of each blade effective part and a part thereof is projecting toward both directions in a turbine rotor circumferential direction out of the blade planting part, in which the cover parts adjacent in the turbine rotor circumferential direction are engaged with each other to make up an annular blade cascade, and in which from among the rotor blades, a cover part of a stopping blade implanted to a planting part of the turbine rotor or the cover part of at least one of the rotor blades engaged with the cover part of the stopping blade is formed at the blade top part of the rotor blade so as to be able to be fitted when the rotor blade is installed in the turbine rotor.

Besides, a steam turbine of an embodiment is characterized in that the turbine rotor blade of the above-stated embodiment is included.

DETAILED DESCRIPTION

Embodiment 1

Figure 1:
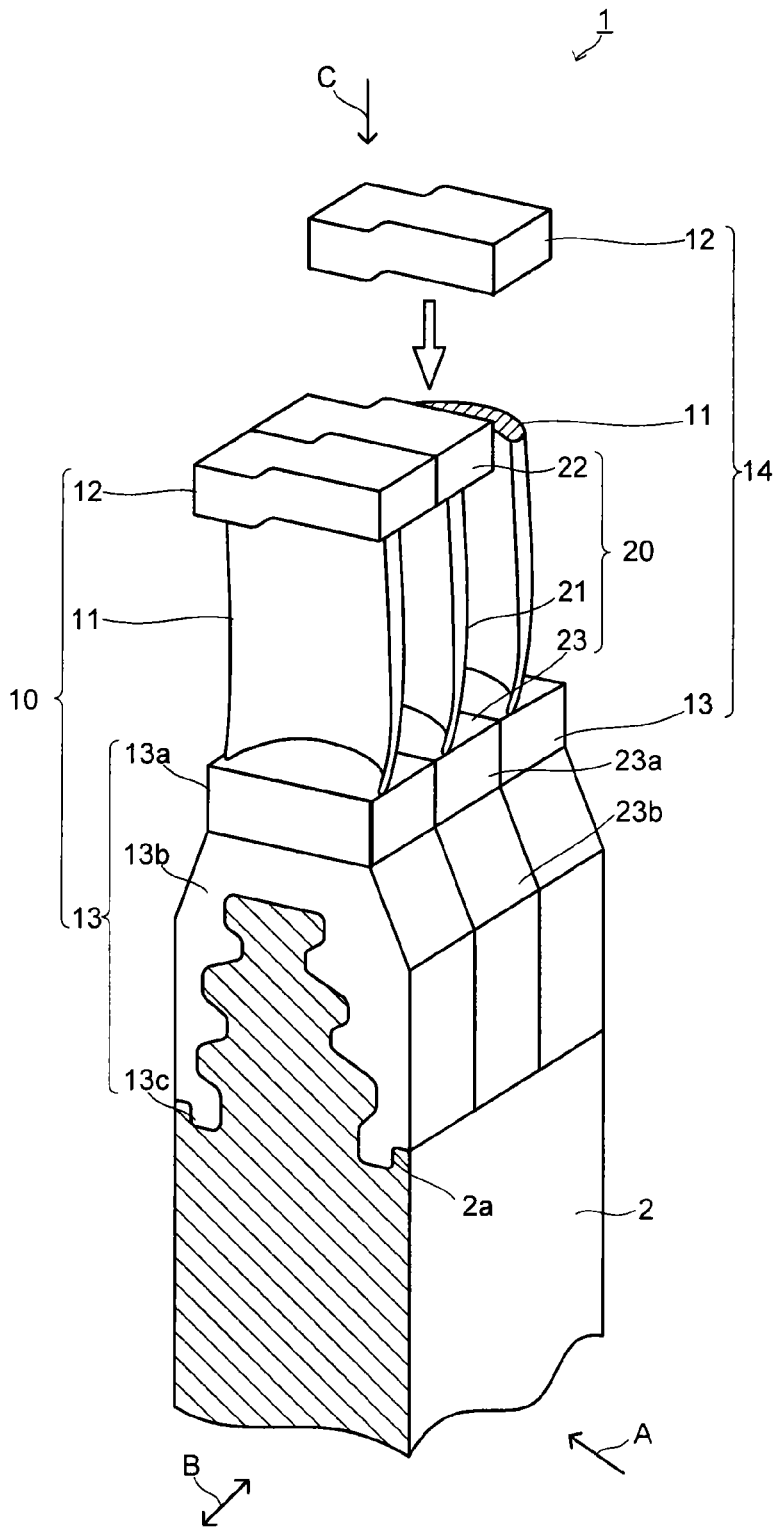
FIG. 1 is a perspective view illustrating a state in which a stopping blade is inserted when a turbine rotor blade of an embodiment 1 is assembled.

Hereinafter, embodiments will be described with reference to the drawings. FIG. 1 is a perspective view illustrating a state in which a stopping blade 20 is inserted when a turbine rotor blade 1 of an embodiment 1 is assembled.

As illustrated in FIG. 1, the turbine rotor blade 1 includes plural rotor blades 10 and the stopping blade 20 to be implanted lastly. These rotor blades 10 and stopping blade 20 form an annular blade cascade by being implanted in a turbine wheel planting part 2 of a turbine rotor. Steam flows into the blade cascade from a turbine rotor axial direction A, and it passes between the rotor blades 10. The turbine rotor blade 1 rotates resulting from the passing of the steam. Note that in FIG. 1, only the rotor blades positioning at both sides in a turbine rotor circumferential direction B of the stopping blade 20 are illustrated from among the rotor blades 10, and one of the rotor blades (a rotor blade positioning at a right side in the drawing) is referred to as a rotor blade 14.

These rotor blades 10, 14 each have a blade effective part 11, a snubber cover (cover part) 12 and an outside type blade planting part 13. Note that in FIG. 1, one of the rotor blades adjacent to the stopping blade 20 is identified as the rotor blade 14 to be expediently distinguished from the other rotor blade 10, but shapes of the blade effective part 11, the snubber cover 12 and the blade planting part 13 of the rotor blade 14 are the same as those of the blade effective part 11, the snubber cover 12 and the blade planting part 13 of the rotor blade 10.

Figure 2:
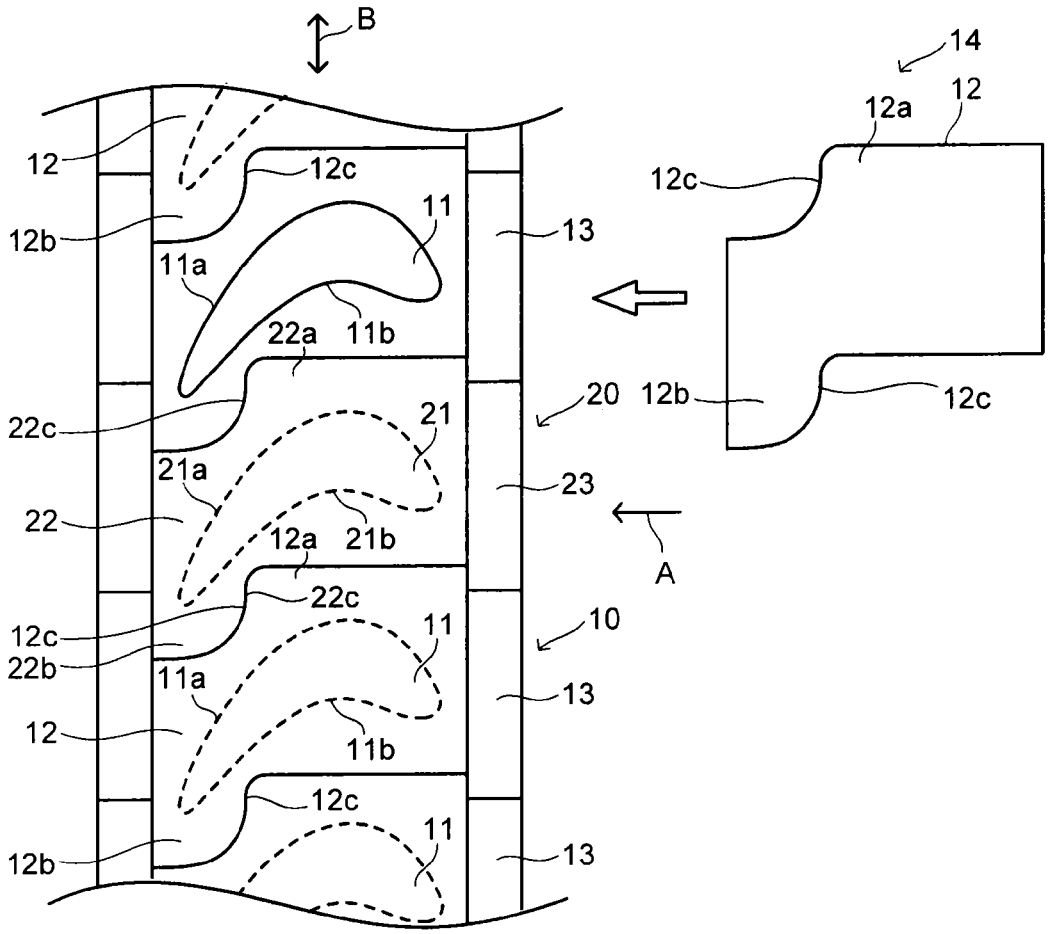
FIG. 2 is an upper surface view illustrating a part of an upper surface of the turbine rotor blade in FIG. 1.

FIG. 2 is an upper surface view illustrating a part of an upper surface of the turbine rotor blade in FIG. 1. As illustrated in FIG. 2, the blade effective parts 11 of the rotor blades 10, 14 each include a blade back 11*a* and a blade face 11*b*, and a cross section thereof is formed approximately in a streamline shape. The blade effective part 11 has a shape to be included in a shape of the snubber cover 12 when it is seen from an upper surface of the snubber cover 12, and it is formed to be a shape in which a cross section thereof becomes a little thick and twisted from a blade top part (snubber cover 12) side toward a blade root part (blade planting part 13) side.

The snubber cover 12 is integrally formed at the blade top part of the blade effective part 11 of the rotor blade 10. Besides, a separately formed snubber cover 12 is attached to the blade top part of the blade effective part 11 of the rotor blade 14 at the time of assembling. This snubber cover 12 includes flared parts 12*a*, 12*b* projecting out of the blade planting part 13 at both sides in the turbine rotor circumferential direction B, and at the blade back 11*a* side and the blade face 11*b* side of the blade effective part 11 and an upper surface thereof is formed approximately in an S-shape.

A cover contact surface 12*c* intersecting with the turbine rotor axial direction A is provided at each of the flared parts 12*a*, 12*b*. The cover contact surfaces 12*c* are strongly in contact with the cover contact surface 12*c* of the adjacent rotor blade 10 and a later-described cover contact surface 22*c* provided at a snubber cover 22 of the stopping blade 20. The flared parts 12*a*, 12*b* of the snubber covers 12 adjacent in the turbine rotor circumferential direction B with each other and the flared parts 12*a*, 12*b* and flared parts 22*a*, 22*b* of the snubber cover 22 are thereby brought into contact so as to be able to be engaged.

As illustrated in FIG. 1, the blade planting part 13 is integrally formed at a blade root part of the blade effective part 11, and is installed in the turbine wheel planting part 2 of the turbine rotor. The blade planting part 13 includes a solid part (blade base) 13*a*, and an outside type leg part 13*b*. The leg part 13*b* is constituted in, for example, a saddle shape branching into two sides. Besides, the blade planting part 13 includes convex parts 13*c* formed along the turbine rotor circumferential direction B at both tip parts of the leg part 13*b* branching into two sides.

On the other hand, groove parts 2*a* functioning as grooves where the convex parts 13*c* of the rotor blades 10, 14 are to be fitted are formed along the turbine rotor circumferential direction B at the turbine wheel planting part 2 of the turbine rotor where the rotor blades 10, 14 are to be implanted.

The blade planting part 13 and the turbine wheel planting part 2 are constituted as stated above, and thereby, each of the cover contact surfaces 12*c* of the snubber covers 12 functions as a torsion return restricting piece restricting untwist (torsion return) generated by a centrifugal force and coupling the adjacent blades, and it is possible to generate a torsion return restricting piece reaction force (a reaction force to restrict the torsion return) between the convex part 13*c* and the groove part 2*a* at the time of a steam turbine operation. It is possible to enough secure a cover contact reaction force generated at the cover contact surface 12*c* of the snubber cover 12 by the generation of the torsion return restricting piece reaction force. It is thereby possible to exhibit a sufficient damping effect. Besides, when the steam turbine is operated, it is possible to enable the whole periphery integral structure with high reliability by surely preventing the torsion return of the snubber cover 12.

As illustrated in FIG. 1, the stopping blade 20 includes a blade effective part 21, the snubber cover (cover part) 22 and a blade planting part 23. As illustrated in FIG. 2, the blade effective part 21 of the stopping blade 20 includes a blade back 21*a* and the blade face 21*b*, and a cross section thereof is formed approximately in a streamline shape. The blade effective part 21 has a shape to be included in a shape of the snubber cover 22 when it is seen from an upper surface of the snubber cover 22, and it is formed to be a shape in which a cross section thereof becomes a little thick and twisted from a blade top part (snubber cover 22) side toward a blade root part (blade planting part 23) side. Besides, the blade effective part 21 and the blade effective parts 11 of the rotor blades 10, 14 are formed to have approximately the same shape.

The snubber cover 22 is integrally formed at the blade top part of the blade effective part 21. This snubber cover 22 includes the flared parts 22*a*, 22*b* projecting out of the blade planting part 23 at both sides in the turbine rotor circumferential direction B and at the blade back 21*a* side and the blade face 21*b* side of the blade effective part 21, and an upper surface thereof is formed approximately in an S-shape. The snubber cover 22 includes the flared parts 22*a*, 22*b* which are in contact with the flared parts 12*a*, 12*b* of the snubber covers 12 of the adjacent rotor blades 10, 14 to be able to be engaged. Besides, the snubber cover 22 and the snubber cover 12 are formed to be approximately the same shape.

A cover contact surface 22*c* intersecting with the turbine rotor axial direction A is provided at each of the flared parts 22*a*, 22*b*. The cover contact surfaces 22*c* are strongly in contact with the cover contact surfaces 12*c* of the adjacent rotor blades 10, 14. The flared parts 12*a*, 12*b* of the snubber cover 12 adjacent in the turbine rotor circumferential direction B and the flared parts 22*a*, 22*b* of the snubber cover 22 are thereby brought into contact so as to be able to be engaged.

As illustrated in FIG. 1, the blade planting part 23 is integrally formed at a blade root part of the blade effective part 21, and is installed in the turbine wheel planting part 2 of the turbine rotor. The blade planting part 23 includes a solid part (blade base) 23*a*, and an outside type leg part 23*b*. The leg part 23*b* is constituted in, for example, a saddle shape branching into two sides. Besides, the blade planting part 23 includes not-illustrated convex parts formed along the turbine rotor circumferential direction B at both tip parts of the leg part 23*b* branching into two sides. The convex parts are formed to be approximately the same as the convex parts 13*c* of the rotor blades 10, 14, and are fitted to the groove parts 2*a* formed along the turbine rotor circumferential direction B of the turbine wheel planting part 2.

Note that the leg part 23*b* and the turbine wheel planting part 2 each include a screw hole (not-illustrated) screwed by a not-illustrated screw. The stopping blade 20 is thereby fixed to the turbine wheel planting part 2 of the turbine rotor.

In the constitution as stated above, the rotor blade 10 and the rotor blade 14 under a state without the snubber cover 12 are installed in the turbine wheel planting part 2 of the turbine rotor from a radial direction of the turbine rotor, and thereafter, the stopping blade 20 of the turbine rotor blade is installed in so as not to come into contact and interfere with the snubber cover 12 of the adjacent rotor blade 10. After the stopping blade 20 is installed from the radial direction of the turbine rotor, the snubber cover 12 is attached to the blade top part of the blade effective part 11 of the rotor blade 14.

As stated above, according to the turbine rotor blade 1 of the present embodiment, the snubber cover 12 of one adjacent rotor blade 14 is separately formed from the blade effective part 11, and the snubber cover 12 is attached to the blade top part of the blade effective part 11 of the rotor blade 14 after all of the rotor blades 10, 14 and the stopping blade 20 are installed in the turbine wheel planting part 2 at the time of assembling of the turbine rotor blade. An inserting space of the stopping blade 20 (blade planting part 23) thereby becomes wide, then the stopping blade 20 (blade planting part 23) is not brought into contact with the snubber cover 12 of the adjacent rotor blade 10, and the assembling of the turbine rotor blade becomes easy.

Note that in this embodiment, the snubber cover 12 of one rotor blade 14 adjacent to the stopping blade 20 is separately formed from the blade effective part 11, but it is not limited thereto, and it is also possible to form the snubber covers 12 of both of the adjacent rotor blades 10, 14 separately from the blade effective parts 11. In this case, the inserting space of the stopping blade 20 (blade planting part 23) becomes further wider, and it is possible to install the stopping blade 20 in the turbine wheel planting part 2 without interfering with the adjacent rotor blades 10, 14.

Figure 3:
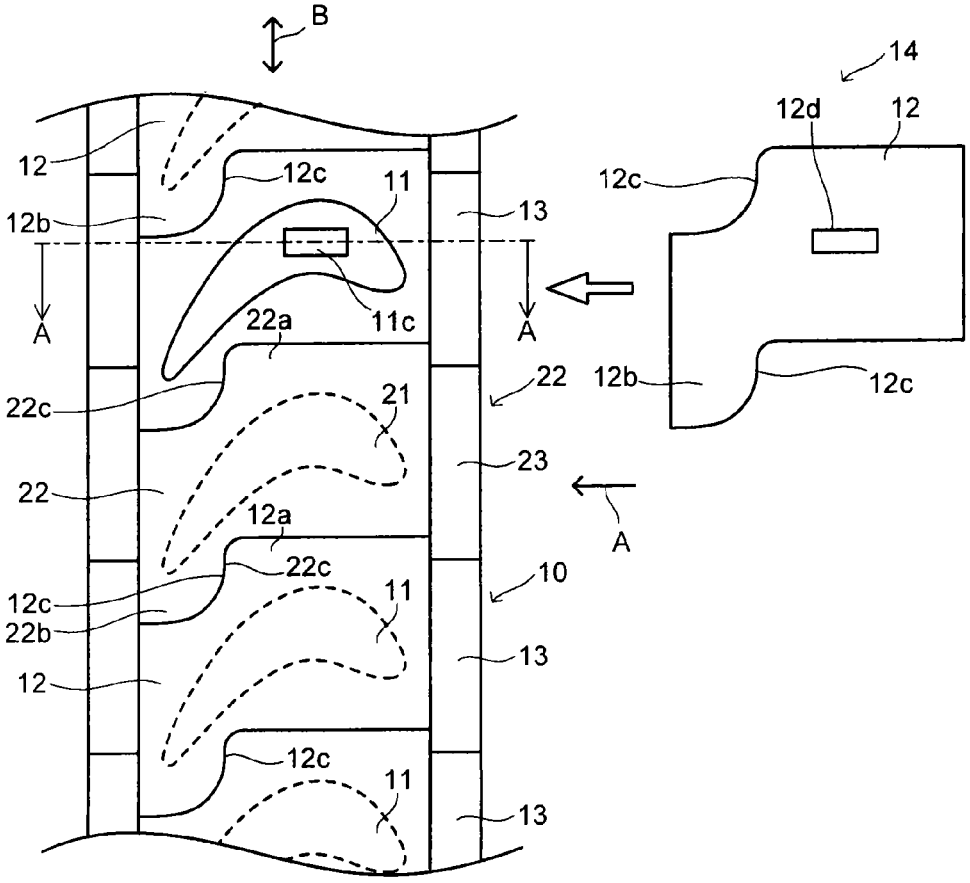
FIG. 3 is an upper surface view illustrating an example of a part of an upper surface of the turbine rotor blade when a snubber cover of the embodiment 1 is attached.
Figure 4:
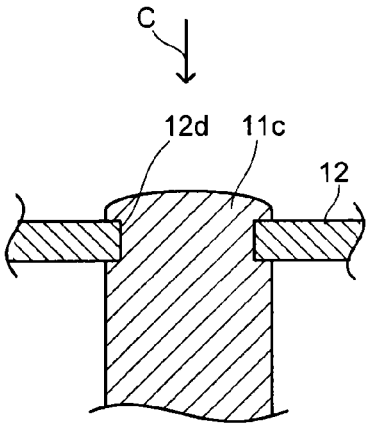
FIG. 4 is a sectional view illustrating an A-A cross section of FIG. 3 under a state in which the snubber cover is attached.

FIG. 3 is an upper surface view illustrating an example of a part of an upper surface of the turbine rotor blade when the snubber cover 12 of the embodiment 1 is attached. FIG. 4 is a sectional view illustrating an A-A cross section of FIG. 3 under a state in which the snubber cover 12 is attached.

As illustrated in FIG. 3 and FIG. 4, a projecting part 11*c* in a rectangular parallelepiped shape is formed at the blade top part of the blade effective part 11 of the rotor blade 14 integrally with the blade top part. The projecting part 11*c* turns a longitudinal direction thereof toward the same direction as a turbine rotor radial direction C when the rotor blade 14 is installed in the turbine wheel planting part 2 of the turbine rotor. Roundness is provided at an edge of a top part of the projecting part 11*c* by enlarging a curvature radius thereof. Namely, R is provided at the edge.

A hole part 12*d* in a rectangular shape is provided at a center part of the snubber cover 12 of the rotor blade 14 and at a position engaging with the projecting part 11*c* by penetrating in the turbine rotor radial direction C, so as to be able to be fitted with the projecting part 11*c*. A major axis and a minor axis of the hole part 12*d* are formed to be a little shorter than a major axis and a minor axis of the top part of the projecting part 11*c*.

At the time of installing, the snubber cover 12 of the rotor blade 10 and the snubber cover 22 of the stopping blade 20 adjacent in the turbine rotor circumferential direction B are brought into contact with each other so as be able to be engaged to constitute the annular blade cascade, and thereafter, the projecting part 11*c* of the blade effective part 11 of the rotor blade 14 and the hole part 12*d* of the snubber cover 12 of the rotor blade 14 are caulked to fix the snubber cover 12 to the blade effective part 11.

The snubber cover 12, and the adjacent snubber cover 22 and snubber cover 12 are thereby fitted, and it is possible to strongly bring the cover contact surfaces 22*c* of the snubber cover 22 into contact with the cover contact surfaces 12*c* of the adjacent rotor blades 10, 14. As a result, the flared parts 12*a*, 12*b* of the snubber cover 12 adjacent in the turbine rotor circumferential direction B are brought into contact with the flared parts 22*a*, 22*b* of the snubber cover 22 so as to be able to be engaged.

As stated above, in the present embodiment, the hole part 12*d* of the snubber cover 12 is caulked and attached to the projecting part 11*c* of the blade effective part 11 of the rotor blade 14 after the stopping blade 20 is installed in the turbine wheel planting part 2, and therefore, it is possible to secure the snubber cover 12 at the blade effective part 11. As a result, the snubber covers integrally provided at the blade top parts are coupled, and it is possible to make the assembling of the turbine rotor blade made up of a blade fastening structure enabling so-called the whole periphery integral blade easy.

Figure 5:
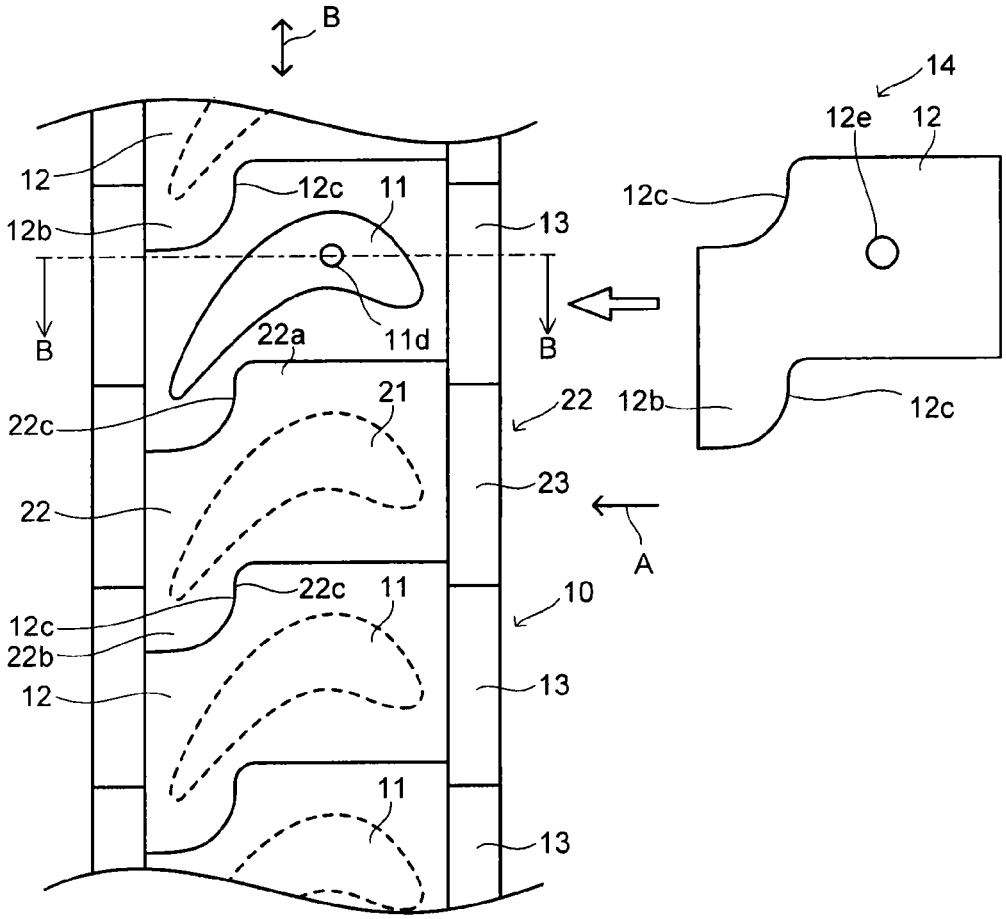
FIG. 5 is an upper surface view illustrating another example of a part of the upper surface of the turbine rotor blade when the snubber cover of the embodiment 1 is attached.
Figure 6:
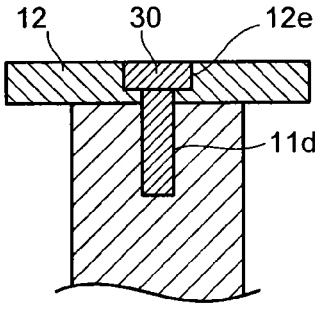
FIG. 6 is a sectional view illustrating a B-B cross section of FIG. 5 under a state in which the snubber cover is attached.

FIG. 5 is an upper surface view illustrating another example of a part of the upper surface of the turbine rotor blade when the snubber cover 12 of the embodiment 1 is attached. FIG. 6 is a sectional view illustrating a B-B cross section of FIG. 5 under a state in which the snubber cover 12 is attached.

As illustrated in FIG. 5 and FIG. 6, a screw hole 11*d* is provided at the blade top part of the blade effective part 11 of the rotor blade 14. Besides, a screw hole 12*e* is also provided at a center part of the snubber cover 12 of the rotor blade 14 and at a position matching with the screw hole 11*d* at the time of installing.

At the time of installing, the snubber cover 12 of the rotor blade 10 and the snubber cover 22 of the stopping blade 20 adjacent in the turbine rotor circumferential direction B are brought into contact so as to be able to be engaged with each other to constitute the annular blade cascade, and thereafter, a screw 30 is screwed into the screw holes 11*d*, 12*e* to thereby fix the snubber cover 12 to the blade effective part 11.

The snubber cover 12, and the adjacent snubber cover 22 and snubber cover 12 are thereby fitted, and it is possible to strongly bring the cover contact surfaces 22*c* of the snubber cover 22 into contact with the cover contact surfaces 12*c* of the adjacent rotor blades 10, 14. As a result, the flared parts 12*a*, 12*b* of the snubber cover 12 adjacent in the turbine rotor circumferential direction B are brought into contact with the flared parts 22*a*, 22*b* of the snubber cover 22 so as to be able to be engaged.

As stated above, in the present embodiment, the blade effective part 11 and the snubber cover 12 of the rotor blade 14 are screwed shut after the stopping blade 20 is installed in the turbine wheel planting part 2, and therefore, it is possible to secure the snubber cover 12 at the blade effective part 11 as same as the above-stated case. As a result, the snubber covers integrally provided at the blade top parts are coupled, and it is possible to make the assembling of the turbine rotor blade made up of a blade fastening structure enabling so-called the whole periphery integral blade easy.

Besides, in this another example of the embodiment, the blade effective part 11 and the snubber cover 12 of the rotor blade 14 are screwed shut, and therefore, it is possible to easily separate the snubber cover 12 from the blade effective part 11 only by detaching the screw 30 at the time of a disassembling for maintenance and so on of the turbine rotor blade.

Embodiment 2

Figure 7:
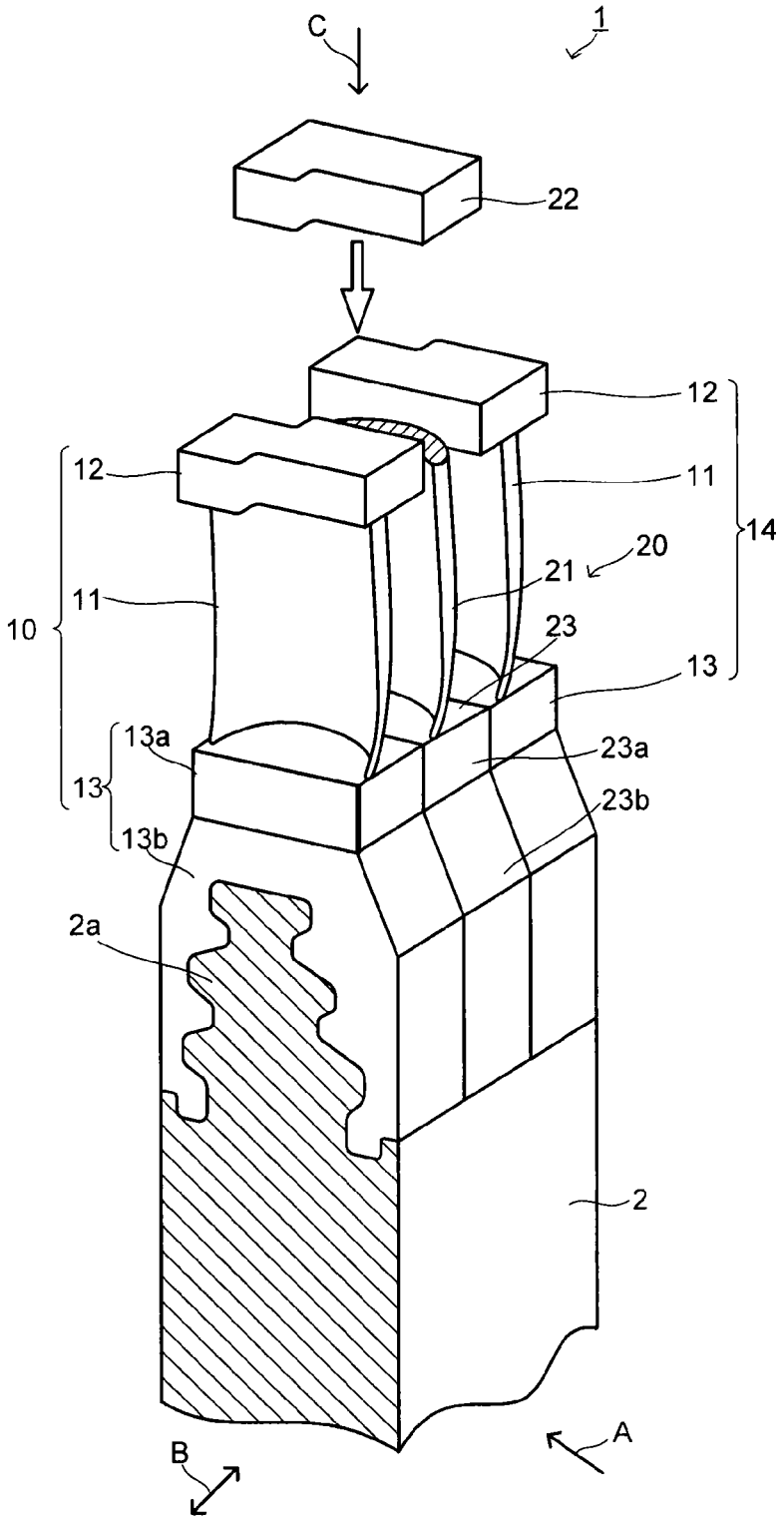
FIG. 7 is a perspective view illustrating a state in which a stopping blade is inserted when a turbine rotor blade of an embodiment 2 is assembled.
Figure 8:
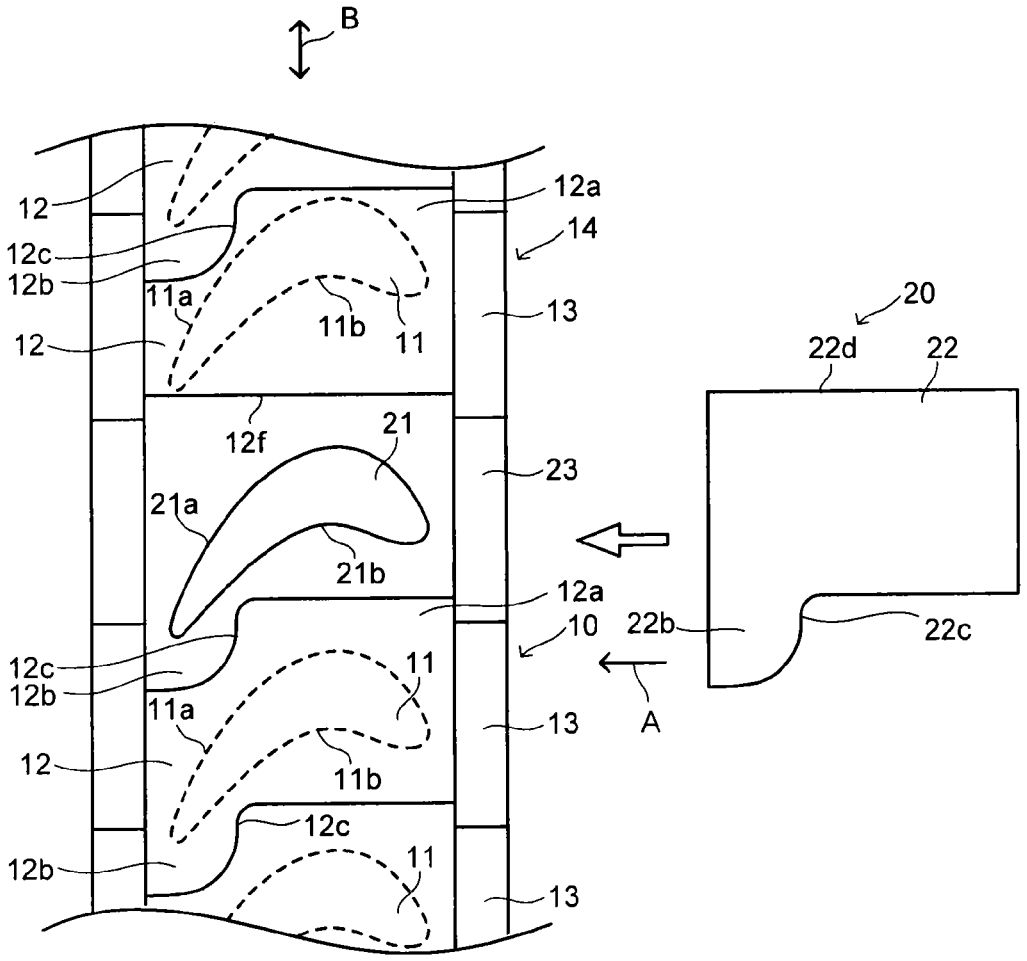
FIG. 8 is an upper surface view illustrating a part of an upper surface of the turbine rotor blade in FIG. 7.

FIG. 7 is a perspective view illustrating a state in which the stopping blade 20 is inserted when the turbine rotor blade 1 of an embodiment 2 of the present invention is assembled. FIG. 8 is an upper surface view illustrating a part of an upper surface of the turbine rotor blade in FIG. 7.

As illustrated in FIG. 7, points different from the embodiment 1 (refer to FIG. 1) are that the snubber cover 12 of the rotor blade 14 is integrally formed at the blade top part of the blade effective part 11 and the separately formed snubber cover 22 is attached to the blade effective part 21 of the stopping blade 20 at the time of assembling.

As illustrated in FIG. 8, the blade effective parts 11, 21 are formed to have shapes included in shapes of the snubber covers 12, 22 when they are seen from upper surfaces of the snubber covers 12, 22. A length of the snubber cover in the turbine rotor circumferential direction B is formed to be longer than a length of the blade planting part 23 in the turbine rotor circumferential direction B.

As illustrated in FIG. 8, the snubber cover 12 of the rotor blade 14 includes the flared part 12*a* projecting out of the blade planting part 13 only at one side in the turbine rotor circumferential direction B and at the blade back 11*a* side of the blade effective part 11, and an upper surface thereof is formed to be approximately an L-shape.

The cover contact surface 12*c* intersecting with the turbine rotor axial direction A is provided at the flared part 12*a*. The cover contact surface 12*c* is strongly in contact with the cover contact surface 12*c* of the adjacent rotor blade 10. The flared part 12*a* of the snubber cover 12 of the rotor blade 14 is thereby brought into contact with the flared part 12*b* of the snubber cover 12 adjacent in the turbine rotor circumferential direction B so as to be able to be engaged.

Besides, the snubber cover 22 of the stopping blade 20 includes the flared part 22*b* projecting out of the blade planting part 23 only at one side in the turbine rotor circumferential direction B and at the blade face 21*b* side of the blade effective part 21, and an upper surface thereof is formed to be approximately an L-shape. The snubber cover 22 is formed to be an adverse L-shape of the snubber cover 12 of the rotor blade 14 in the turbine rotor axial direction A.

The cover contact surface 22*c* intersecting with the turbine rotor axial direction A is provided at the flared part 22*b*. The cover contact surface 22*c* is strongly in contact with the cover contact surface 12*c* of the adjacent rotor blade 10. The flared part 12*a* of the snubber cover 12 adjacent in the turbine rotor circumferential direction B is thereby brought into contact with the flared part 22*b* of the snubber cover 22 so as to be able to be engaged.

Besides, the snubber cover 12 of the rotor blade 14 includes a flat cover contact surface 12*f* formed at one side in the turbine rotor circumferential direction B and at the blade face 11*b* side of the blade effective part 11, and the snubber cover 22 of the stopping blade 20 includes a flat cover contact surface 22*d* formed at one side in the turbine rotor circumferential direction B and at the blade back 21*a* side of the blade effective part 21. The cover contact surface 12*f* and the cover contact surface 22*d* are brought into contact so as to be able to be engaged at the time of assembling.

In the constitution as stated above, the rotor blades 10, 14 are installed in the turbine wheel planting part 2 of the turbine rotor from the radial direction of the turbine rotor, and thereafter, the rotor blade 14 is installed under a state in which the snubber cover 22 does not exist so that the stopping blade 20 of the turbine rotor blade to be implanted into the turbine wheel planting part 2 later does not come into contact and interfere with the snubber covers 12 of the adjacent rotor blades 10, 14. After the stopping blade 20 is installed from the radial direction of the turbine rotor, the snubber cover 22 is attached to the blade top part of the blade effective part 11 of the stopping blade 20.

As stated above, according to the turbine rotor blade 1 of the present embodiment, the snubber cover 22 of the stopping blade 20 is separately formed from the blade effective part 11, and the snubber cover 22 is attached to the blade top part of the blade effective part 11 of the stopping blade 20 after all of the rotor blades 10, 14 and the stopping blade 20 are installed in the turbine wheel planting part 2 at the time of assembling of the turbine rotor blade. The stopping blade 20 (blade planting part 23) is not thereby brought into contact with the snubber cover 12 of the adjacent rotor blade 10, and the assembling of the turbine rotor blade becomes easy.

Figure 9:
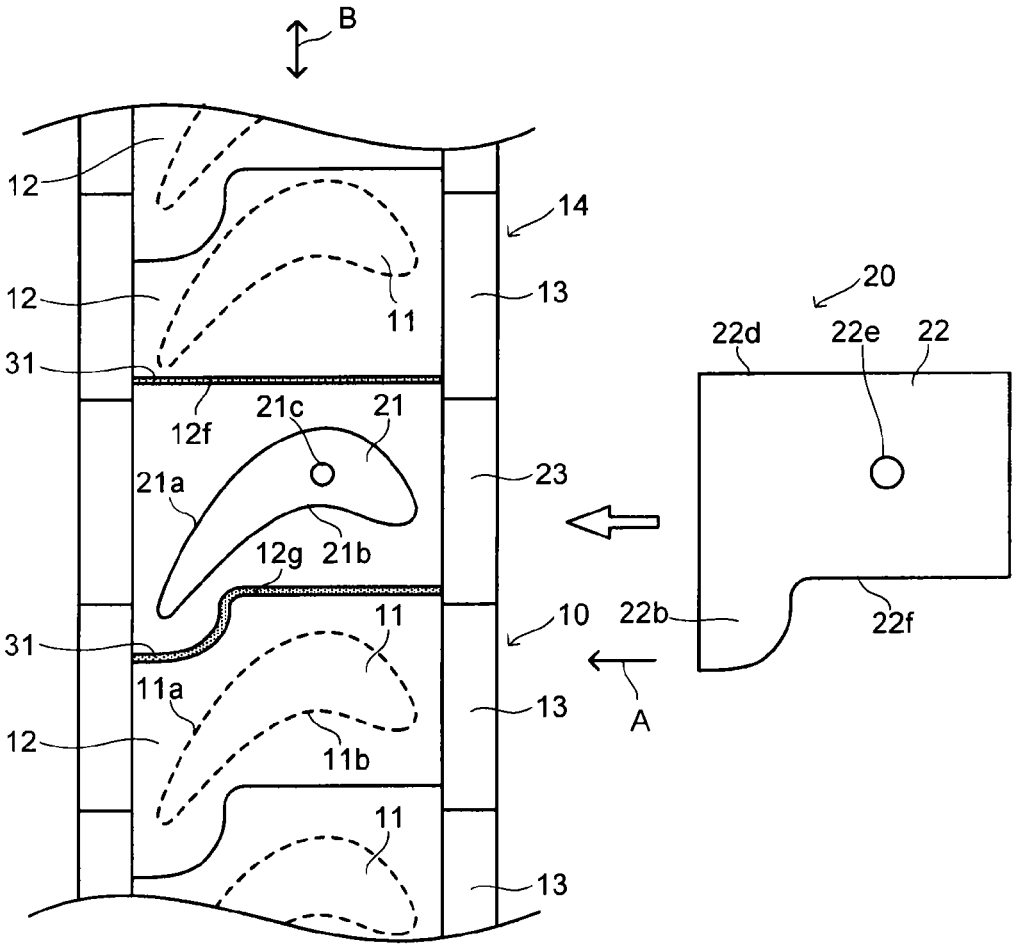
FIG. 9 is an upper surface view illustrating an example of a part of the upper surface of the turbine rotor blade when a snubber cover of the embodiment 2 is attached.

FIG. 9 is an upper surface view illustrating an example of a part of an upper surface of the turbine rotor blade when the snubber cover 22 of the embodiment 2 is attached. As illustrated in FIG. 9, a screw hole 21*c* is provided at the blade top part of the blade effective part 21 of the stopping blade 20. Besides, a screw hole 22*e* is provided at a center part of the snubber cover 22 of the stopping blade 20 and at a position matching with the screw hole 21*c* at the time of installing.

At the time of installing, the snubber cover 12 of the rotor blade 10 and the snubber cover 22 of the stopping blade 20 adjacent in the turbine rotor circumferential direction B are brought into contact so as to be able to be engaged with each other to constitute the annular blade cascade, and thereafter, a screw as same as FIG. 6 is screwed into the screw holes 21*c*, 22*e* to thereby fix the snubber cover 22 to the blade effective part 21.

Next, the cover contact surface 12*f* of the rotor blade 14 and the cover contact surface 22*d* of the stopping blade 20, a cover contact surface 12*g* of the rotor blade 10 and a cover contact surface 22*f* of the stopping blade 20 are welded to be joints 31, to thereby fix the snubber cover 22 and the snubber cover 12 adjacent thereto. It is thereby possible to fit the snubber cover 12, and the adjacent snubber cover 22 and snubber cover 12, and to fix the snubber cover 22 and the snubber covers 12 adjacent thereto.

As stated above, in the present embodiment, the stopping blade 20 is installed in the turbine wheel planting part 2, and thereafter, the blade effective part 21 and the snubber cover 22 of the stopping blade 20 are screwed shut, and the snubber cover 22 and the snubber covers 12 adjacent thereto are welded, and therefore, it is possible to secure the snubber cover 22 at the blade effective part 21 as same as the above-stated case. As a result, the snubber covers integrally provided at the blade top parts are coupled, and it is possible to make the assembling of the turbine rotor blade made up of the blade fastening structure enabling so-called the whole periphery integral blade easy.

Figure 10:
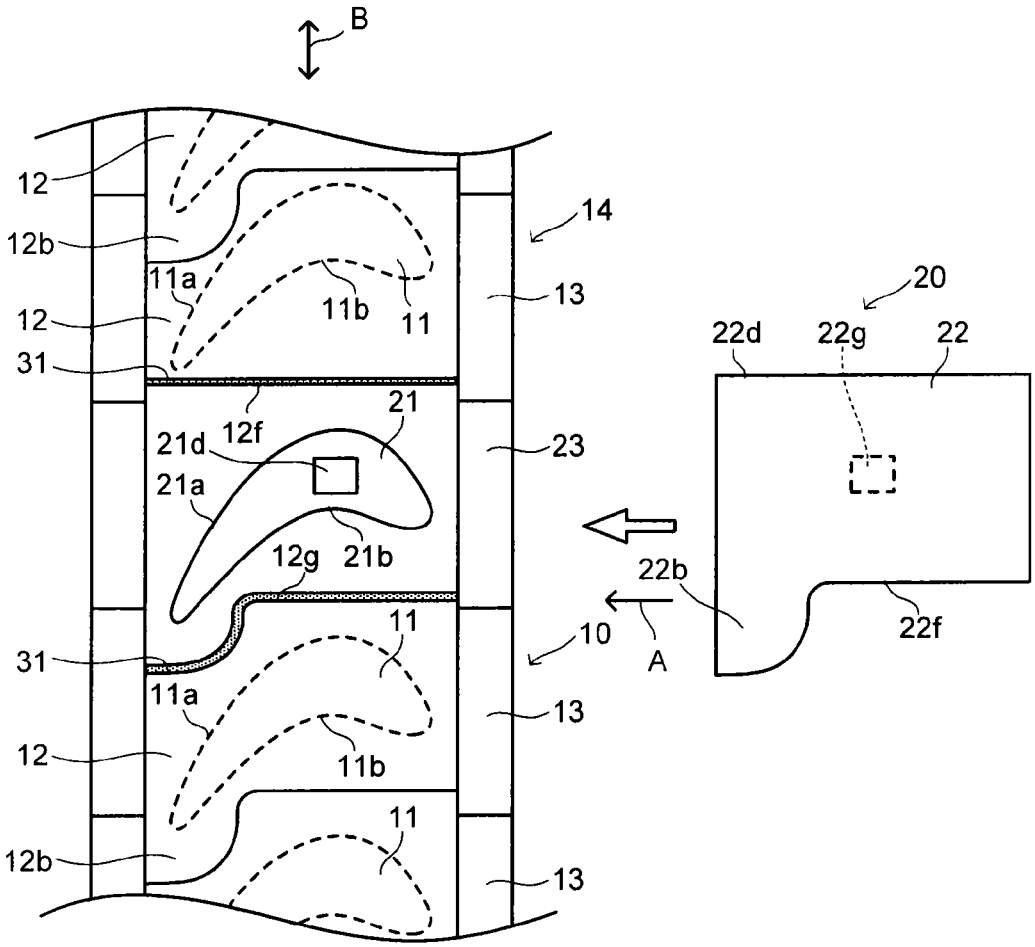
FIG. 10 is an upper surface view illustrating another example of a part of the upper surface of the turbine rotor blade when the snubber cover of the embodiment 2 is attached.
Figure 11:
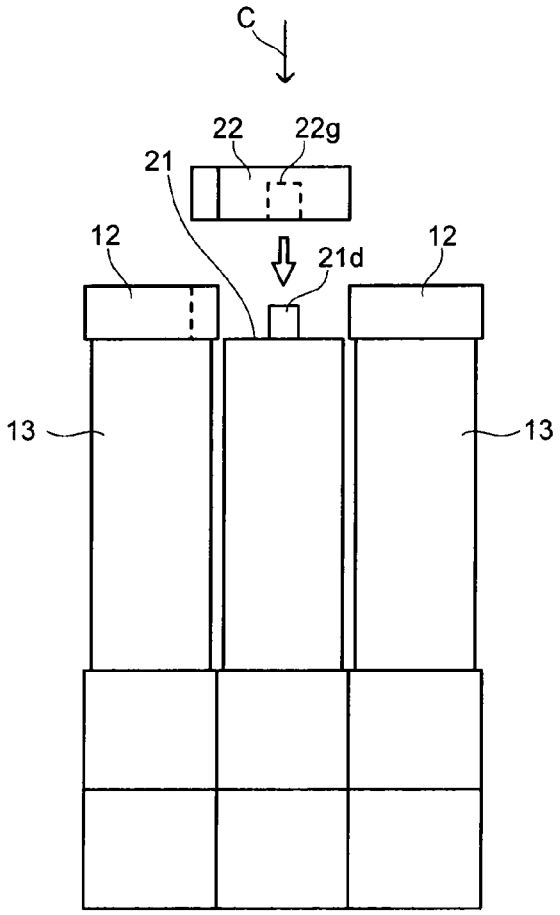
FIG. 11 is a side view illustrating a side surface of FIG. 10.
Figure 12:
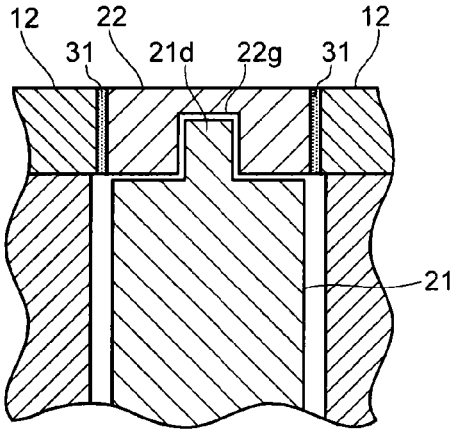
FIG. 12 is a sectional view illustrating a cross section of the side surface of FIG. 10 under a state in which the snubber cover is attached.

FIG. 10 is an upper surface view illustrating another example of a part of the upper surface of the turbine rotor blade when the snubber cover 22 of the embodiment 2 is attached. FIG. 11 is a side view illustrating a side surface of FIG. 10. FIG. 12 is a sectional view illustrating a cross section of the side surface of FIG. 10 under a state in which the snubber cover 22 is attached.

As illustrated in FIG. 10, a point different from the embodiment in FIG. 9 is that a convex part 21*d* is integrally formed with the blade top part at the blade top part of the blade effective part 21 of the stopping blade 20. The convex part 21*d* projects toward the turbine rotor radial direction C (refer to FIG. 11) when the stopping blade 20 is installed in the turbine wheel planting part 2.

Besides, a concave part 22*g* is provided at a center part of a lower surface of the snubber cover 22 in the turbine rotor radial direction C (refer to FIG. 11) and at a position engaging with the convex part 21*d* to be able to be fitted with the convex part 21*d*.

At the time of installing, the snubber cover 12 of the rotor blade 10 and the snubber cover 22 of the stopping blade 20 adjacent in the turbine rotor circumferential direction B are brought into contact so as to be able to be engaged with each other to constitute the annular blade cascade, and thereafter, the convex part 21*d* of the blade effective part 21 of the stopping blade 20 and the concave part 22*g* of the snubber cover 22 of the stopping blade 20 are fitted (refer to FIG. 11, FIG. 12) to thereby fix the snubber cover 22 to the blade effective part 21.

Next, the cover contact surface 12*f* of the rotor blade 14 and the cover contact surface 22*d* of the stopping blade 20, the cover contact surface 12*g* of the rotor blade 10 and the cover contact surface 22*f* of the stopping blade 20 are welded to be the joints 31, to thereby fix the snubber cover 22 and the snubber covers 12 adjacent thereto. It is thereby possible to fit the snubber cover 12, and the adjacent snubber cover 22 and snubber cover 12, and to fix the snubber cover 22 and the snubber covers 12 adjacent thereto.

As stated above, in the present embodiment, the stopping blade 20 is installed in the turbine wheel planting part 2, and thereafter, the blade effective part 21 and the snubber cover 22 of the stopping blade 20 are fitted, and the snubber cover 22 and the snubber covers 12 adjacent thereto are welded, and therefore, it is possible to secure the snubber cover 22 at the blade effective part 21 as same as the above-stated case. As a result, the snubber covers integrally provided at the blade top parts are coupled, and it is possible to make the assembling of the turbine rotor blade made up of the blade fastening structure enabling so-called the whole periphery integral blade easy.

Note that in the present embodiment, the convex part 21*d* is provided at the blade top part of the blade effective part 21 of the stopping blade 20 and the convex part 21*d* is provided at the lower surface of the snubber cover 22 of the stopping blade 20, but the present invention is not limited thereto, and it is also possible that a convex part is provided at the lower surface of the snubber cover 22 of the blade effective part 21 of the stopping blade 20 and a concave part is provided at the blade effective part 21 of the stopping blade 20, and the convex part and the concave part are fitted at the time of installing in the turbine rotor.

As described above, according to the above-stated embodiment, it is possible to insert the stopping blade without interfering with the adjacent blade and to make the assembling of the turbine rotor blade easy.

It should be noted that the present invention is not limited to the above-described embodiments as they are, and in an implementation stage, it can be embodied by modifying components thereof within a range not departing from the spirit of the invention. Also, the plural components disclosed in the above-described embodiments can be appropriately combined to form various inventions. For example, some of all the components shown in the embodiments may be eliminated. Moreover, components from different embodiments may be combined appropriately.

What is claimed is:

1. A turbine rotor provided with a plurality of rotor blades, each of the plurality of rotor blades comprising:

a blade effective part;

a blade planting part formed at a bottom of the blade effective part to install in the turbine rotor from a radial direction of the turbine rotor; and a cover part formed at a top of the blade effective part, the cover part having a projecting part configured to project toward both directions in a circumferential direction of the turbine rotor out of the blade planting part, the cover part being engaged with an adjacent cover part in the circumferential direction of the turbine rotor to make up an annular blade cascade along the circumferential direction of the turbine rotor, wherein one of the rotor blades is a stopping blade implanted to the turbine rotor, the cover part of only the stopping blade is formed by engaging at a top of the blade effective part of the stopping blade, and each of the cover parts of the rotor blades other than the stopping blade is formed integrally with each top of the blade effective parts of the rotor blades other than the stopping blade.

2. The turbine rotor according to claim 1, wherein the stopping blade includes a first screw hole at the top of the blade effective part, and includes a second screw hole capable of being screwed shut with the first screw hole at the cover part; and wherein contact surfaces between the cover part of the stopping blade and the cover part of the rotor blade adjacent to the stopping blade are welded.

3. The turbine rotor according to claim 1, wherein the stopping blade includes a convex part at either one of the cover part or the top of the blade effective part, includes a concave part capable of being fitted to the convex part at the other one; and wherein contact surfaces between the cover part of the stopping blade and the cover part of the rotor blade adjacent to the stopping blade are welded.

4. A steam turbine, comprising:

the turbine rotor according to claim 1.

5. A turbine rotor provided with a plurality of rotor blades, the plurality of rotor blades comprising:

a first rotor blade having a first cover part formed by engaging at a top of the first rotor blade, the first cover part having a projecting part configured to project toward both directions in a circumferential direction of the turbine rotor; and a second rotor blade provided at adjacent to the first rotor blade in the circumferential direction of the turbine rotor, the second rotor blade being implanted to the turbine rotor lastly among the rotor blades, the second rotor blade having a second cover part integrally formed at a top of the second rotor blade, the second cover part having a projecting part configured to project toward both directions in the circumferential direction of the turbine rotor, the second cover part being engaged with the first cover part in the circumferential direction of the turbine rotor to make up an annular blade cascade along the circumferential direction of the turbine rotor.

6. A turbine rotor provided with a plurality of rotor blades, the plurality of rotor blades comprising:

a first rotor blade having a first cover part integrally formed at a top of the first rotor blade, the first cover part having a projecting part configured to project toward both directions in a circumferential direction of the turbine rotor; and a second rotor blade provided at adjacent to the first rotor blade in the circumferential direction of the turbine rotor, the second rotor blade being implanted to the turbine rotor lastly among the rotor blades, the second rotor blade having a second cover part formed by engaging at a top of the second rotor blade, the second cover part having a projecting part configured to project toward both directions in the circumferential direction of the turbine rotor, the second cover part being engaged with the first cover part in the circumferential direction of the turbine rotor to make up an annular blade cascade along the circumferential direction of the turbine rotor.

7. A turbine rotor provided with a plurality of rotor blades, each of the plurality of rotor blades comprising:

a blade effective part;

a blade planting part formed at a bottom of the blade effective part to install in the turbine rotor from a radial direction of the turbine rotor; and a cover part formed at a top of the blade effective part, the cover part having a projecting part configured to project toward both directions in a circumferential direction of the turbine rotor out of the blade planting part, the cover part being engaged with an adjacent cover part in the circumferential direction of the turbine rotor to make up an annular blade cascade along the circumferential direction of the turbine rotor, wherein one of the rotor blades is a stopping blade implanted to the turbine rotor, the cover part of a pre-determined rotor blade adjacent to the stopping blade is formed by engaging at a top of the blade effective part of the pre-determined rotor blade, and each of the cover parts of the rotor blades other than the pre-determined rotor blade is formed integrally with each top of the blade effective parts of the rotor blades other than the pre-determined rotor blade.

8. The turbine rotor according to claim 7, wherein the pre-determined rotor blade includes a projecting part at the top of the blade effective part, and includes a hole part capable of being fitted with the projecting part at the cover part.

9. The turbine rotor blade according to claim 7, wherein the pre-determined rotor blade includes a first screw hole at the top of the blade effective part, and includes a second screw hole capable of being screwed shut with the first screw hole at the cover part.

10. A steam turbine, comprising:

the turbine rotor according to claim 7.

* * * * *